US007325847B1

(12) United States Patent
Tanner

(10) Patent No.: US 7,325,847 B1
(45) Date of Patent: Feb. 5, 2008

(54) HOUSEHOLD APPARATUS FOR HOLDING WINDOWS OPEN

(76) Inventor: John Tanner, 132 Lincoln Rd., Winter Haven, FL (US) 33884

( * ) Notice: Subject to any disclaimer, the term of this patent is extended or adjusted under 35 U.S.C. 154(b) by 157 days.

(21) Appl. No.: 11/327,991

(22) Filed: Jan. 9, 2006

(51) Int. Cl.
*E05C 17/54* (2006.01)

(52) U.S. Cl. ..... 292/339; 292/259 R; 49/449

(58) Field of Classification Search ..... 292/262, 292/278, 338, 339, 259 R; 49/449, 450
See application file for complete search history.

(56) References Cited

U.S. PATENT DOCUMENTS 556,696 A 3/1896 Sands
782,412 A * 2/1905 Neudorff ..... 292/306
1,498,996 A * 6/1924 Bray ..... 292/275
1,528,876 A * 3/1925 Gaydos ..... 49/450
1,773,751 A * 8/1930 Reidhaar ..... 292/267
2,090,550 A * 8/1937 Pilblad ..... 248/410
2,407,837 A * 9/1946 Kissel ..... 292/288
2,551,657 A 5/1951 Chambers
2,702,205 A * 2/1955 Germain ..... 160/95
2,766,492 A 10/1956 Day et al.
3,136,290 A * 6/1964 Bailey et al. ..... 116/67 R

* cited by examiner

*Primary Examiner*—Gary Estremsky

(57) ABSTRACT

A device for maintaining an openable window in a desired position within a window frame is provided. The device comprises a rod having a top end and a bottom end and a housing having a top end, a bottom end, a front surface, and a rear surface. A first aperture is formed in the to the housing. A second aperture is formed in the bottom end of the housing with the rod slidably receivable into the first aperture, through the housing, and out of the second aperture. A grasping mechanism is secured on the housing for releasably grasping the openable window. An adjusting mechanism selectively adjusts the position of the housing on the rod.

10 Claims, 2 Drawing Sheets

HOUSEHOLD APPARATUS FOR HOLDING WINDOWS OPEN

BACKGROUND OF THE INVENTION

1. Field of the Invention

The present invention concerns that of a household apparatus for holding windows open, and more particularly, the present invention relates to a household apparatus for holding windows open which is secured to the window with an adhesive material.

2. Description of the Prior Art

U.S. Pat. No. 2,766,492, issued to Day, discloses a window sash device having a rack and pinion assembly.

U.S. Pat. No. 2,551,567, issued to Chambers, discloses a window sash device having a rack and pinion assembly.

U.S. Pat. No. 556,696, issued to Sands, discloses a sash balance device comprised of rectangular tube weights having a plurality of teeth.

SUMMARY

The present invention concerns that of a household apparatus for holding windows open. The household apparatus has a steel rod that has caps located at each end of the steel rod. The household apparatus also has a mounting block that can be moved up or down on the steel rod. The bottom edge of the window is mounted on the mounting block, allowing the window to be mounted at various heights as desired by an individual.

There has thus been outlined, rather broadly, the more important features of a household apparatus for holding windows open that the detailed description thereof that follows may be better understood and in order that the present contribution to the art may be better appreciated. There are, of course, additional features of the household apparatus for holding windows open that will be described hereinafter and which will form the subject matter of the claims appended hereto.

In this respect, before explaining at least one embodiment of the household apparatus for holding windows open in detail, it is to be understood that the household apparatus for holding windows open is not limited in its application to the details of construction and to the arrangements of the components set forth in the following description or illustrated in the drawings. The household apparatus for holding windows open is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present household apparatus for holding windows open. It is important, therefore, that the claims be regarded as including such equivalent constructions insofar as they do not depart from the spirit and scope of the present invention.

It is therefore an object of the present invention to provide a household apparatus for holding windows open which has all of the advantages of the prior art and none of the disadvantages.

It is another object of the present invention to provide a household apparatus for holding windows open which may be easily and efficiently manufactured and marketed.

It is another object of the present invention to provide a household apparatus for holding windows open which is of durable and reliable construction.

It is yet another object of the present invention to provide a household apparatus for holding windows open which is economically affordable and available for relevant market segment of the purchasing public.

Other objects, features and advantages of the present invention will become more readily apparent from the following detailed description of the preferred embodiment when considered with the attached drawings and appended claims.

DETAILED DESCRIPTION OF THE PREFERRED EMBODIMENTS

Figure 1:
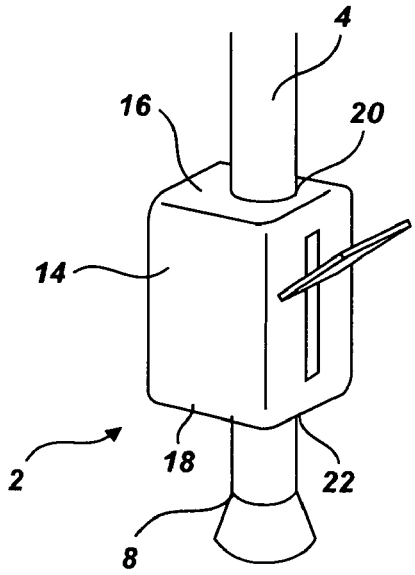
FIG. 1 is a perspective view illustrating a household apparatus for holding windows open, constructed in accordance with the present invention, without the mounting block.

FIG. 1 illustrates a side view of the household apparatus 2, while

Figure 2:
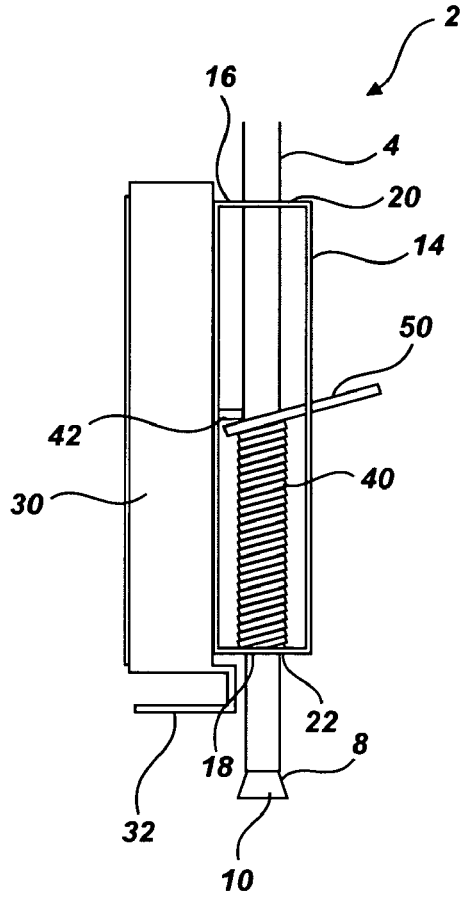
FIG. 2 is a sectional side view illustrating the household apparatus for holding windows open, constructed in accordance with the present invention, with the mounting block.
Figure 3:
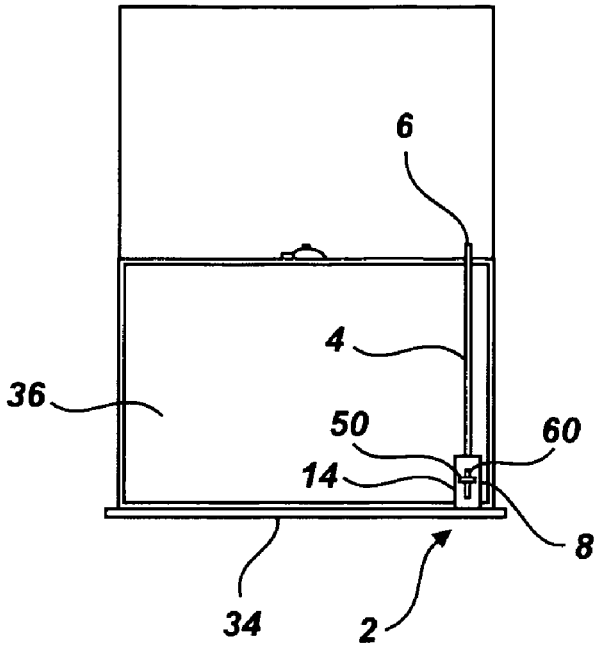
FIG. 3 is a front view illustrating the household apparatus for holding windows open, constructed in accordance with the present invention, as it would appear in use with a window closed.
Figure 4:
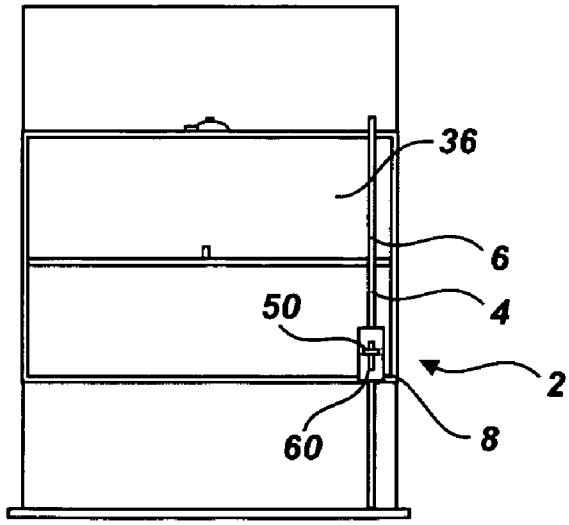
FIG. 4 is a front view illustrating the household apparatus for holding windows open, constructed in accordance with the present invention, as it would appear in use with a window open halfway.

FIG. 2 illustrates a sectional side view of the household apparatus 2. Furthermore, FIG. 3 illustrates a front view of the household apparatus 2 as it would appear in use with a window closed, while FIG. 4 illustrates a front view of the household apparatus 2 as it would appear in use with a window open halfway.

The household apparatus 2 comprises a central rod 4 that has two ends, a top end 6 and a bottom end 8. Preferably, the rod 4 is constructed from a steel material having a diameter of one-quarter (¼") inch, however, constructing the rod 4 from other materials is within the scope of the present invention. Attached to each end of the rod 4 is a cap 10 to help provide additional friction for the ends of the rod 4 when it is in use.

The central rod 4 of the household apparatus 2 is inserted through a lock housing 14 with the lock housing 14 slidable along the central rod 4. The lock housing 14 has two ends, a top end 16 and a bottom end 18, and also has two surfaces, a front surface and a rear surface, with the top end 16 of the lock housing 14 having a hole 20 and a the bottom end 18 of the lock housing 14 having a hole 22. The rod 4 is inserted through both of these holes, causing the lock housing 14 to, in effect, be mounted on the rod 4.

The lock housing 14 itself has a rear-mounted mounting block 30 attached to the rear surface of the lock housing 14. In a preferred embodiment, the mounting block 30 has an adhesive material applied thereto for allowing the mounting block 30 to adhere to the window. A liner (not shown) can be applied to the adhesive material that can be removed to expose the adhesive upon installation.

The mounting block is designed to adhere directly onto the lower corner of the window glass using the two face adhesive material. The adhesive surface preferably has dimensions of approximately two (2") inches by three (3") inches which is sufficient for support at least approximately fifteen (15 lbs.) pounds.

In another embodiment, the hanger 30 has a bottom-mounted C-channel 32 which is used to grasp onto the bottom lip 34 of a window 36.

The lock housing 14 is mostly hollow and has a central spring 40 wound around the rod within the inside of the lock housing 14, with the central spring 40 having two ends, a top end 16 and a bottom end 18. A holding bar 42 mounted to the lock housing 14 inside the lock housing 14 is located approximately halfway in between the top end 16 and the bottom end 18 of the lock housing 14, with a release lever (pivoting tab) 50 extending outward from the front surface of the lock housing 14 through groove 60.

The release lever 50 has two ends, a first end and a second end, with the first end of the release lever 50 being wedged in between the central spring 40 and the holding bar 42. The second end of the release lever 50 is the portion of the release lever 50 that extends outward from the front surface of the lock housing 14 through groove 60. When the lock housing 14 is not being moved up or down, the release lever 50 is jammed against both the top of the spring 40 and against the holding bar 42.

When the lock housing 14 is not being moved up or down, the release lever 50 is held at such an angle that is prohibits down movement of the entire lock housing 14. However, when the portion of the release lever 50 that sticks out of the front surface of the lock housing 14 is moved in a general downward direction, the release lever 50 becomes perpendicular to the rod 4, allowing the entire lock housing 14 and hanger 30 to be moved down by essentially pushing down with the release lever 50.

Once a desired position is reached, then the individual merely needs to let go of the release lever 50, causing the release lever 50 to snap back into its angled position. After this occurs, then the lock housing 14 and the window will stay in the same position. The lock housing 14 is designed to lock only when weight or force is applied in the down position. Because the weight of the steel rod 4 is greater than the force of the central spring 40, the locking housing 14 will always move freely in the up position without the rod 4 lifting off the window sill or having to release the locking tab.

As can be seen in FIGS. 3 and 4, once the apparatus 2 is secured to the window, the top end of the rod 4 does not even need to be placed against anything, as the weight between the bottom end of the rod 4 combined with the weight being held by the lock housing 14 and the hanger 30 cause the rod 4 to stay in place.

The household apparatus 2 of the present invention is a pivoting tab locking device. The release lever 50 preferably has a length of approximately one (1") inch and a width of approximately three-quarters (¾") inch, with a one-quarter (¼") hole, that rests on the spring 40 encased in the hollow lock housing 14. The lock housing 14 is preferably constructed from a plastic material having a length of approximately two and one-half (2½") inches, a width of approximately one (1") inch, and a depth of approximately one (1") inch with a hole in the top and bottom having a diameter of approximately one-quarter (¼") inch. The lock housing 14 is attached vertically to the mounting block 30. The rod 4 extends vertically through holes in the lock housing 14, the hole in the release lever 50, and the spring 40. The combined depth of the lock housing 14 and the mounting block 30 is approximately two (2") inches which allows the rod 4 to overcome the original window lip (or handle) and sit with the rubber bumper 10 on the window sill. A rubber bumper at the top of the rod 4 inhibits the combined lock housing 14 and the mounting block 30 from sliding off the top of the steel rod 4.

When the window is opened, the release lever 50 pushes down on the spring 40 allowing the rod 4 to stay stationary on the window sill while the window is moving up. With the weight of the window, the release lever 50 pivots up and inhibits the mounting block 30 secured to the window from sliding down the rod 4. The release lever 50 is mechanically linked through the housing as a release tab to be pressed down with the thumb, while the fingers secure the weight of the window.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A household apparatus for holding a window open in combination with a window, the household apparatus comprising:

a rod having a top end and a bottom end, a pair of caps comprising a first cap and a second cap, the first cap attached to the top end of the rod, the second cap attached to the bottom end of the rod, a lock housing having a top end and a bottom end, the lock housing also having a front surface and a rear surface, a pair of holes comprising a top hole and a bottom hole, the top hole being located at the top end of the lock housing, the bottom hole being located at the bottom end of the lock housing, wherein the lock housing is mounted on the rod by having the rod inserted through the two holes of the pair of holes, means for adjusting the position of the lock housing on the rod, a mounting block secured to the lock housing, and securing means on the mounting block for securing the mounting block to the window, wherein the mounting block is hollow, wherein the window has a bottom lip, and wherein the securing means is a hanger attached to the rear surface of the mounting block, the hanger including a C-clip, wherein the lip of the window is inserted into the C-clip on the hanger.

2. A household apparatus for holding a window open in combination with a window according to claim 1 wherein the means for adjusting the position of the mounting block on the rod further comprises:

a central spring wound around a portion of the rod that is located within the lock housing, a holding bar attached to the lock housing within the inside of the lock housing, a release lever having a first end and a second end, the first end of the release lever being wedged in between the central spring and the holding bar, the second end of the release lever extending outward from the front surface of the lock housing, wherein the release lever is normally in an angled position relative to the rod when the lock housing is not being moved up or down, further wherein the second end of the release lever is moved downward, the release lever becomes exactly perpendicular to the rod, permitting down movement of the lock housing on the rod.

3. A household apparatus for holding a window open in combination with a window according to claim 1 wherein the securing means is an adhesive material applied to the mounting block.

4. A device for maintaining an openable window in a desired position within a window frame, the device comprising:

a rod having a top end and a bottom end;

a housing having a top end, a bottom end, a front surface, and a rear surface;

a first aperture formed in the housing;

a second aperture formed in the bottom end of the housing, the rod slidably receivable into the first aperture, through the housing, and out of the second aperture;

grasping means formed on the housing for releasably grasping the openable window; and adjusting means for selectively adjusting the position of the housing on the rod, wherein the grasping means includes a C-clip hanger attached to a mounting block on the rear surface of the housing.

5. The device of claim 4 wherein the adjusting means further comprises: a central spring within the housing and slidably wound around a portion of the rod positioned within the housing;

a holding bar attached to the housing within the inside of the housing; and a release lever having a first end and a second end, the first end of the release lever being wedged in between the central spring and the holding bar, the second end of the release lever extending outward from the front surface of the housing;

wherein the release lever is normally in an angled position relative to the rod when the housing is not being moved up or down, further wherein the second end of the release lever is moved downward, the release lever becomes exactly perpendicular to the rod, permitting up and down movement of the housing on the rod.

6. The device of claim 4 and further comprising:

a pair of caps comprising a first cap and a second cap, the first cap attached to the top end of the rod, the second cap attached to the bottom end of the rod.

7. The device of claim 4 wherein the grasping means is an adhesive material securable to the window.

8. The device of claim 4 wherein the lip of the window is inserted into the C-clip on the hanger.

9. The device of claim 4 wherein the housing is hollow.

10. The device of claim 4 wherein the housing includes the lock housing and a mounting block secured to the lock housing.

* * * * *